US005878682A

United States Patent [19]

Hulbig et al.

[11] Patent Number: 5,878,682

[45] Date of Patent: Mar. 9, 1999

[54] WATERCRAFT AND HULL SYSTEMS

[75] Inventors: William F. Hulbig, Norfolk; Anthony J. Scappaticci, Bolton, both of Mass.

[73] Assignee: MicroMarine, Ltd., Mendon, Mass.

[21] Appl. No.: 637,403

[22] Filed: Apr. 25, 1996

[51] Int. Cl.[6] ..... B63B 1/00

[52] U.S. Cl. ..... 114/56; 114/271; 114/61; 114/39.1; 440/26

[58] Field of Search ..... 114/61, 39.1, 352, 114/345, 68, 69; 440/21–31, 271, 6

[56] References Cited

U.S. PATENT DOCUMENTS

| | | | |
|---|---|---|---|
| 4,668,196 | 5/1987 | Billmayer et al. | 440/26 |
| 4,811,676 | 3/1989 | Franke | 114/61 |
| 4,968,274 | 11/1990 | Gregory | 440/27 |
| 5,313,908 | 5/1994 | Kunz | 114/354 |
| 5,349,918 | 9/1994 | Elie | 114/352 |
| 5,381,752 | 1/1995 | Eerdmans | 114/270 |
| 5,413,066 | 5/1995 | Spencer, Jr. et al. | 440/27 |
| 5,427,554 | 6/1995 | Foglia | 440/26 |
| 5,651,706 | 7/1997 | Kasper | 440/29 |

*Primary Examiner*—Jesus D. Sotelo

*Attorney, Agent, or Firm*—Peter F. Corless; Dike, Bronstein, Roberts & Cushman LLP

[57] ABSTRACT

The invention includes new hull systems and watercraft. In particular, the invention provides a watercraft hull that has a pivot axis forward of the hull waterline fore-aft center line. That pivot axis will be the deep water point of the hull and provides a fulcrum point around which the hull turns during a direction change. The forward pivot axis surprisingly imparts high maneuverability (i.e. the ability to execute turns of reduced radius) relative to prior systems, even at low speeds.

38 Claims, 6 Drawing Sheets

WATERCRAFT AND HULL SYSTEMS

BACKGROUND OF THE INVENTION

1. Field of the Invention

The present invention relates to improved watercraft and hull systems and methods that comprise use of the same. In particular, the invention provides a novel watercraft that exhibits high maneuverability even at relatively low speeds such as provided by a pedal-operated propulsion system.

2. Background

A variety of pedal-operated boats and other watercraft having low-powered propulsion systems are currently produced, particularly for recreational use. See generally U.S. Pat. Nos. 5,427,554; 5,413,066; 5,381,752; 5,349,918; 5,313,908; 4,968,274; and 4,668,196.

However, such recreational watercraft exhibit some significant shortcomings despite their popularity. For example, limited maneuverability has been a persistent problem of many types of watercraft, especially crafts having low-powered propulsion systems. Poor maneuverability is a particular problem for pedal-operated watercraft because of their typically fixed propulsion systems as well as wide beam designs. It is also considered that pedal craft and other watercraft having low-powered propulsion systems would experience increased popularity if they could be operated at higher speeds.

Another challenge has been to render a pedal boat or other such small watercraft portable so that the craft can be readily transported, e.g. from a user's home to a waterfront site. While various attempts to provide portable watercraft have been reported, the need clearly still exists for improved designs, particularly watercraft that can be transported by a single person conveniently, including those that can be stored and transported at a compact size.

It thus would be desirable to have new watercraft that provide good maneuverability even at low operating speeds. It also would be desirable to have such watercraft that exhibit enhanced operating speeds with use of a low-powered propulsion system. It would be further desirable to have such watercraft that could be readily transported by a single person.

SUMMARY OF THE INVENTION

The invention provides new hull systems and watercraft that provide surprisingly good maneuverability, even at low operating speeds.

More particularly, the invention provides a watercraft hull that has a pivot axis that is forward of the hull waterline fore-aft center line. That pivot axis will be the deep water point of the hull and provides a fulcrum point around which the hull turns during a direction change.

That forward pivot axis surprisingly imparts high maneuverability (i.e. the ability to execute turns of reduced radius) relative to prior systems, even at low speeds. For example, watercraft of the invention typically can execute a 90° turn within a distance of about twice the craft's length. In contrast to the present invention, prior pedal-operated craft and other low powered systems have generally employed a fulcrum point or pivot axis that is essentially coincident with the craft's waterline fore-aft centerpoint or centerline.

Preferred hulls of the invention have a substantially semi-circular cross-sectional shape below the hull's waterline. Even more preferably, the fore-aft centerline of that semi-circular cross-sectional design is substantially parallel to the hull's waterline, and the cross-sectional diameter decreases both fore and aft from the hull's pivot axis to provide a tapered hull profile. It is further preferred that both the bow and stern of a hull taper or "cone" upwards relative to the hull mid-section. It has been found that design significantly enhances a watercraft's performance, including operating efficiency (i.e. speed based on a given output from the craft's propulsion system). Upward tapering toward a hull's bow also can impart improved stability, particularly when maneuvering a watercraft in rough waters such as through waves.

Watercraft are also provided that contain one or more hulls of the invention. Preferred watercraft of the invention include multi-hull designs such as catamarans and trimarans.

Watercraft of the invention may also comprise a rudder system that is preferably positioned aft of the craft's waterline fore-aft centerline. More preferably, the rudder is positioned aft of the craft's waterline fore-aft centerline, but forward of the craft's stern, e.g. proximate to the craft's waterline aft point. It has been found that such positioning of the rudder can enhance a craft's maneuverability as well as operating efficiency.

With the rudder positioned aft, a watercraft propulsion system (e.g. propeller and associated drive apparatus) may be suitably positioned substantially coincident or forward of the craft's waterline fore-aft centerline. The propulsion system also may be positioned aft of the waterline fore-aft centerline if desired. Watercraft of the invention also suitably may not include a separate rudder, and the propulsion system itself may be movable (steerable) to enable steering of the vessel. It is generally preferred however that the watercraft propulsion system, and particularly the drive propeller, is located substantially coincident with the craft's pivot axis, and the rudder is positioned aft of the craft's waterline fore-aft centerline, preferably proximate to the craft's waterline aft point.

Preferred watercraft of the invention include those that are portable and can be readily transported as desired, even by a single person. In particular, preferred portable watercraft include inflatable hulls and a modular propulsion and steering and seating system. Thus, the propulsion/steering/seating system can be removed, the hulls deflated and the entire craft stored and transported in a single carrying bag with a total weight of less than about 70 pounds. The dimensions of the craft as stored in a carrying bag or other container may suitably be about 10 cubic feet or less, or even about 9, 8 or 7 cubic feet or less.

Watercraft can be powered by a variety of systems such a pedal system, solar power or a motorized system. One preferred system is a pedal-operated drive.

It also has been found that watercraft of the invention exhibit surprisingly high operating speeds from use of low powered propulsion systems such as a pedal drive system.

Other aspects of the invention are disclosed infra.

DETAILED DESCRIPTION OF THE INVENTION

Figure 1:
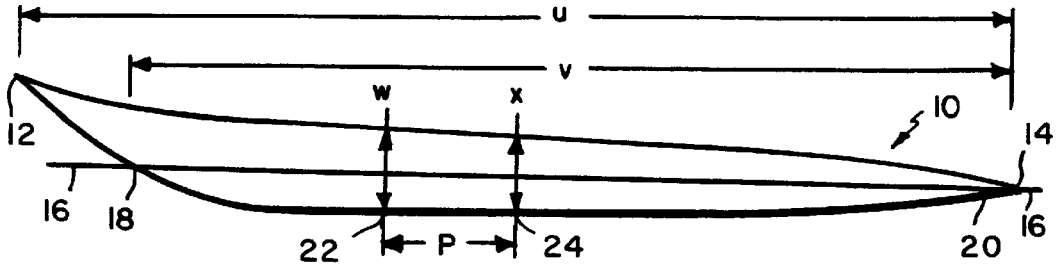
FIG. 1 depicts a schematic side view of a hull of the invention.

Referring now to the Drawings, where particularly preferred hulls and watercraft of the invention are depicted, FIG. 1 shows watercraft hull 10 that includes bow 12, aft point or stem 14 and a waterline 16. (References herein to a hull's or watercraft's waterline or various waterline positions designate the specified waterline with the hull or watercraft not carrying the weight and consequent displacement of any passengers or added passenger cargo, such as the watercraft shown in FIGS. 7 and 9 of the drawings). That waterline 16 also defines waterline bow point 18, i.e. the forward point of the hull that intersects waterline 16, and waterline aft point 20, i.e. the aft point of the hull that intersects waterline 16.

The deepest point of hull 10 in the water and below line 16 is pivot axis 22 which is forward (toward bow 12) of the waterline fore-aft center line 24. That centerline 24 is defined by and is equidistant between bow point 18 and aft point 20.

It has been found that enhanced maneuverability is provided if the pivot axis 22 is positioned at any of a variety of positions forward of water line fore-aft center line 24. Preferably however, the pivot axis is positioned forward of the fore-aft centerline (distance p in FIG. 1) from about 50 to about 60 or 75 percent of the distance from the fore-aft center line to the waterline bow point.

Figure 2:
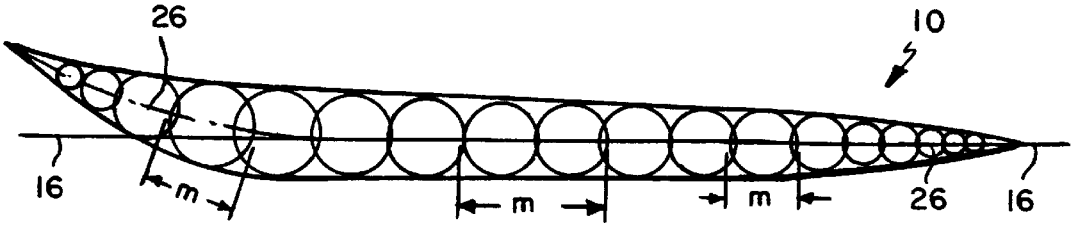
FIG. 2 is a diagrammatical cross-sectional view of a preferred hull of the invention.
Figure 3:
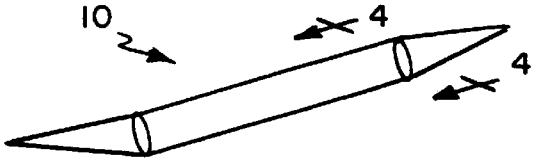
FIG. 3 shows a schematic above view of a hull of the invention.
Figure 4:
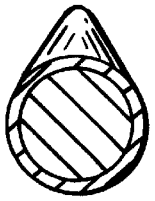
FIG. 4 shows a cross-sectional view along the line 4—4 of FIG. 2.

As discussed above, preferably hulls of the invention have a substantially semi-circular cross-sectional shape below the hull's waterline. As generally shown in FIGS. 2–4, the entire hull may be substantially circular in cross-sectional shape if desired. However, preferred hulls may suitably have an above-waterline shape of essentially any design, including non-circular cross-sectional shapes, provided the hull's below-waterline cross-sectional shape is substantially semi-circular. For example, for aesthetic reasons, the above-waterline cross-sectional shape may be substantially rectangular or other desired configuration. It also will be understood that use of an inflatable hull may restrict the options for such above-waterline alternative designs.

It is also preferred that the fore-aft centerline of that semi-circular cross-sectional design is substantially parallel to the hull's waterline. The term "fore-aft centerline" of the cross-sectional semi-circular shape refers to the line that would bisect the full or completed circular shape defined by the hull's below-waterline semi-circular shape. That fore-aft centerline 26 is clearly shown in FIG. 2 of the drawings. FIG. 2 also shows the preferred design where the fore-aft centerline 26 of that semi-circular cross-sectional design is substantially parallel to the hull's waterline 16.

Figure 5:
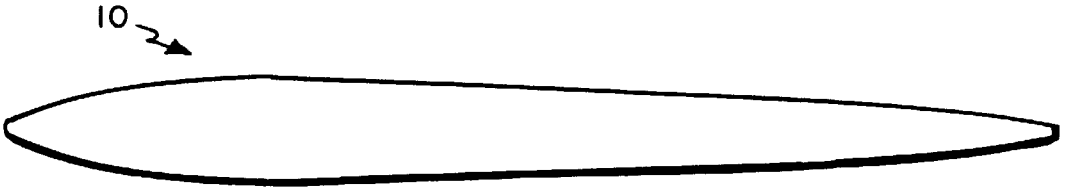
FIG. 5 shows a bottom view of a waterline cross-section of a preferred hull of the invention.

It is further preferred that the cross-sectional diameter (distance m in FIG. 2) decreases, preferably substantially constantly, from the hull's pivot axis to the fore and aft points 12 and 14. As discussed above, that design as can be seen in FIG. 5 can enhance a watercraft's performance, including operating efficiency. The design also provides an aesthetically pleasing tapered profile as can be seen in FIG. 1.

Hulls of the invention can be formed from a variety of materials. An inflatable hull should be formed from a sufficiently durable material so that the hull is substantially puncture resistant. For example, a coated synthetic is suitable such as a urethane coated polyester including commercially available material sold as type 710, count 18×21, 1000 denier. Such coated polyester is available from the Uretek Co. of New Haven, Conn. and sold under the tradenames of U-2219 which is particularly suitable for hull top portions and U-2218 which is preferred for hull bottom surfaces below the waterline.

Figure 6:
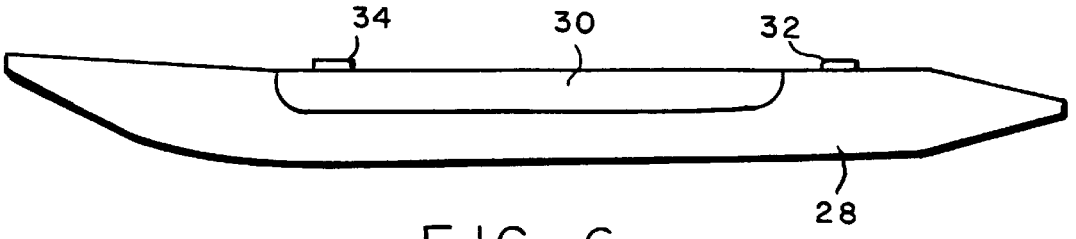
FIG. 6 shows a schematic of a preferred inflation design of an inflatable hull of the invention.

Hull inflation can be provided by using one or more inflation bladders such as those formed from a urethane material, e.g. a Deerfield urethane. A particularly preferred inflation bladder system is depicted in FIG. 6 of the drawings. That design employs a multiple bladder chamber system where a first or bottom bladder chamber 28 is positioned beneath a second or top bladder chamber 30. Bladder 30 suitably has a smaller inflation volume or size than first bladder 28, e.g. about 40 to 50 percent of the inflation volume of the larger bladder 28. Typically, the highest risk of puncture would be with the bottom bladder 28 because only that bladder chamber is beneath the hull waterline. Also, while the top bladder 30 is preferably smaller than bladder 28, the preferred inflation volume mentioned above and central positioning as generally depicted in FIG. 6 will be sufficient to keep a hull or watercraft level in the fore and aft plane in the event of puncture or other degradation of bottom bladder 28. Bladders 28 and 30 may be conveniently inflated via valves 32 and 34 respectively. With the bladder system shown in FIG. 6, to inflate a hull, top bladder 30 is preferably inflated to about half to three quarters of its volume followed by complete inflation of bottom bladder 28. Inflation may be made via manual or powered pumps as are commercially available.

Fiberglass hulls also may be suitably employed that include a hollow fiberglass hull body that is filled at least in part with a suitable flotation material.

Figure 7:
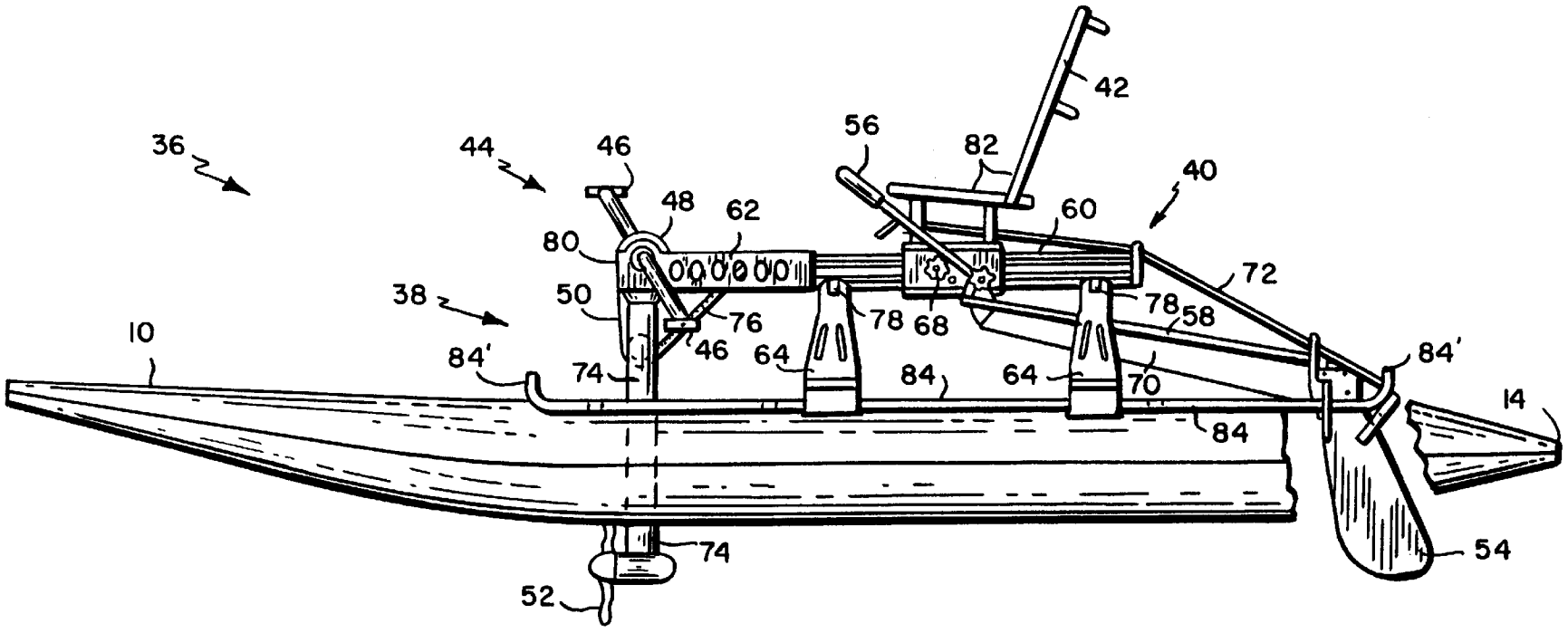
FIG. 7 shows a side view in partial cut-away of a preferred watercraft of the invention.
Figure 8:
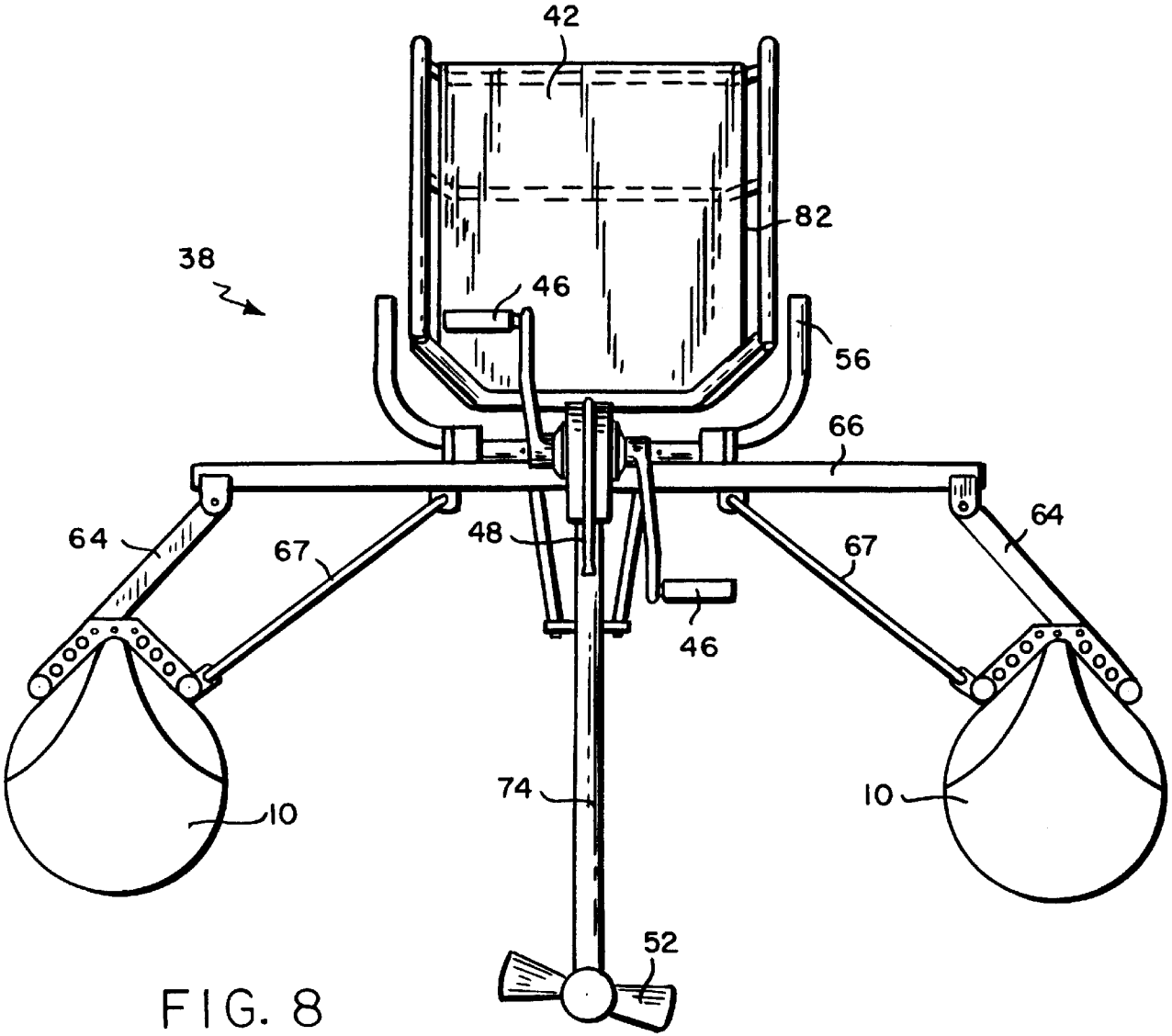
FIG. 8 shows a front view of a preferred propulsion/steering/seating system of the invention.
Figure 9:
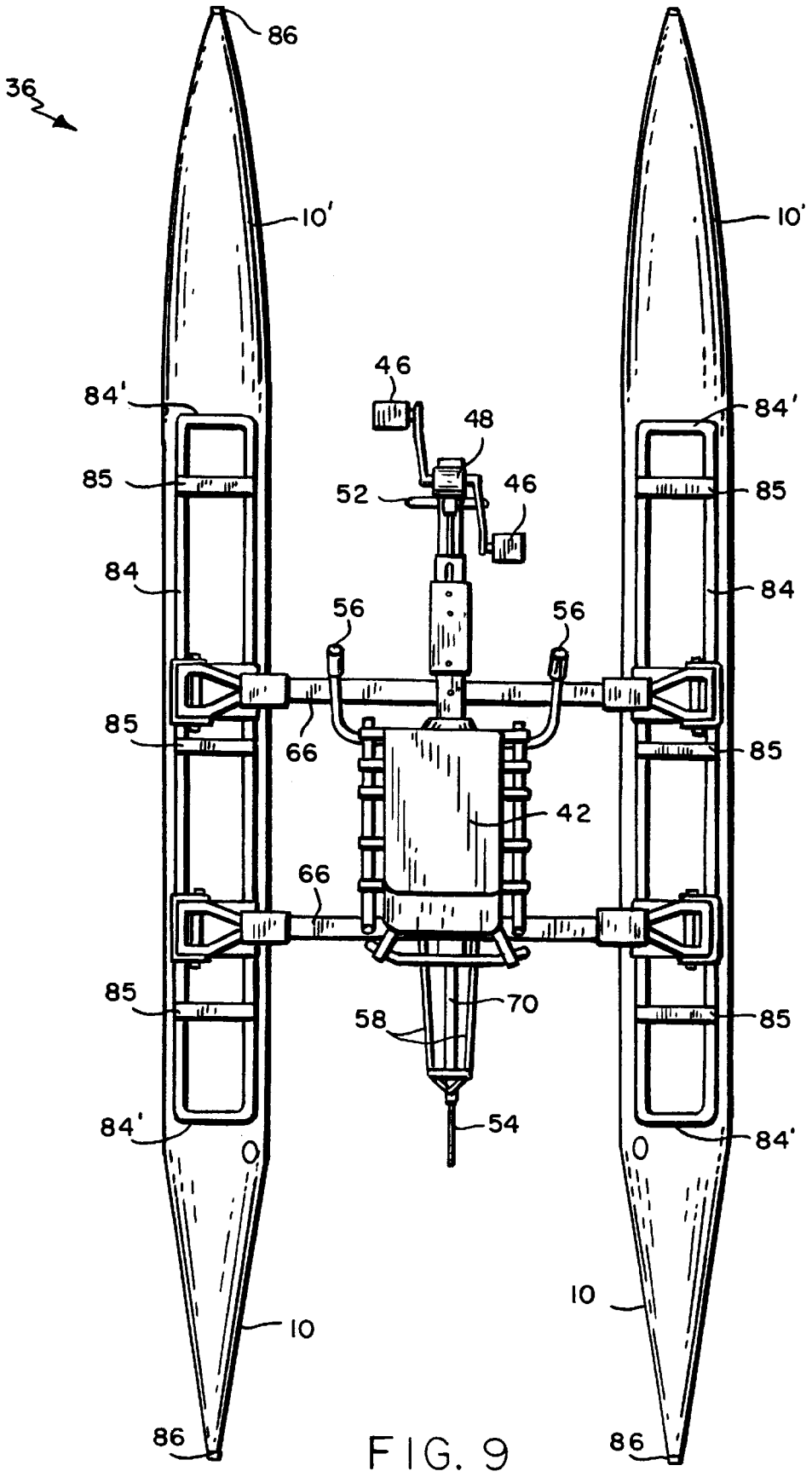
FIG. 9 shows a top view of a preferred watercraft of the invention.

Suitable dimensions of hulls and watercraft of the invention can suitably vary rather widely and can be readily determined by those skilled in the art based on the present disclosure. More particularly, with reference to the preferred hull design shown in the drawings, hull length (length u in FIG. 1) suitably may be from about 8 to about 30 feet and, in the case of a single passenger design as depicted in FIGS. 7 and 9, length u preferably is about 16 feet. Hull waterline length (length v in FIG. 1) suitably may be from about 7 to about 25 feet, and in the case of a single passenger design as depicted in FIGS. 6 and 8, length v is about 14 feet. The height of the forward deep water point or pivot axis (height w in FIG. 1) is suitably from about 9 to about 13 inches, and preferably is about 12 inches; the height of the waterline fore-aft centerline (height x in FIG. 1) is suitably from about 8 to about 12 inches, and preferably is about 11 inches. Generally, height w will be about at least 4 to 10 percent greater height x, more typically the height of the forward deep water point or pivot axis (height w) will be from about 5 to 20 or 25 or 30 percent greater than the height of the waterline fore-aft centerline (height x). Height w being from about 8 or 9 to 20 percent greater than height x is also preferred. The width of a hull at the waterline of the hull's pivot axis is suitably from about 8 to 10 inches. The width (beam) of a twin-hulled craft such as depicted in FIG. 9 is suitably from about 4 to 7.5 feet, preferably about 5.5 feet. Again, these dimensions are merely for some preferred craft designs, and crafts having other dimensions also will be suitable. It also should be appreciated that preferred values may vary depending on the number of passengers a craft is designed to carry, particularly with respect to craft length.

A preferred multi-hull watercraft 36 of the invention is shown in FIGS. 7 and 9. The craft has a catamaran design (two hulls 10) with a combined propulsion/steering/seating system 38 mounted across the hull top surfaces 10'. That system 38 includes a frame unit 40 that spans the multiple hulls 10 and on which is mounted seat 42 and propulsion system 44. That system 44 includes pedals 46 with encased bevel gears and shaft 48 that together drive propeller 52 that extends into the water during use of the craft. The propulsion system suitably may include more than one propeller drives if desired. Other drive systems also may be employed, e.g. with respect to a pedal-operated craft, a chain and sprocket wheel system may be employed. The propulsion system can be secured in a desired position during operation of the craft by chord 50 or other means. FIG. 7 also shows a preferred pull-type propeller that faces forward. Use of such a pull-type propeller provides shallow draft operation of a watercraft, i.e. the propeller can pivot within drive mount 62 and retract toward the craft's stern, even to a level above the hull bottom surfaces, and still provide effective propulsion for the craft.

The depicted preferred design includes one or more aft rudders 54 to enable steering by a passenger in seat 42 using one or more tillers 56. As is clear from FIGS. 7 and 8, tillers 56 manipulate rudders 54 via steering control arms 58 which preferably operate on a bell crank system where the pair of arms 58 push and pull together to manipulate the rudder as desired.

FIG. 7 also depicts a preferred positioning of rudder 54 as discussed above. That is, rudder 54 is positioned forward of aft or stern point 14 and hull 10 tapers or cones upward toward that aft point (as well as toward bow point 12 as shown in FIGS. 1 and 7). It is believed that enhanced operating speeds and maneuverability is provided by such positioning of the rudder forward of the extreme end of a hull in combination with the upward tapering or coning of the hull proximate to the hull aft waterline point. In particular, during forward direction operation of a watercraft, water can exit beneath the upwardly extending hull aft section and the rudder can thereby function effectively at a position forward of the hull's stern 14. Also, as discussed above, upward tapering of the hull toward bow 12 as shown in FIGS. 1 and 7 can improve stability and ease of operation of a watercraft, particularly when steering through waves or other rough water.

Figure 11:
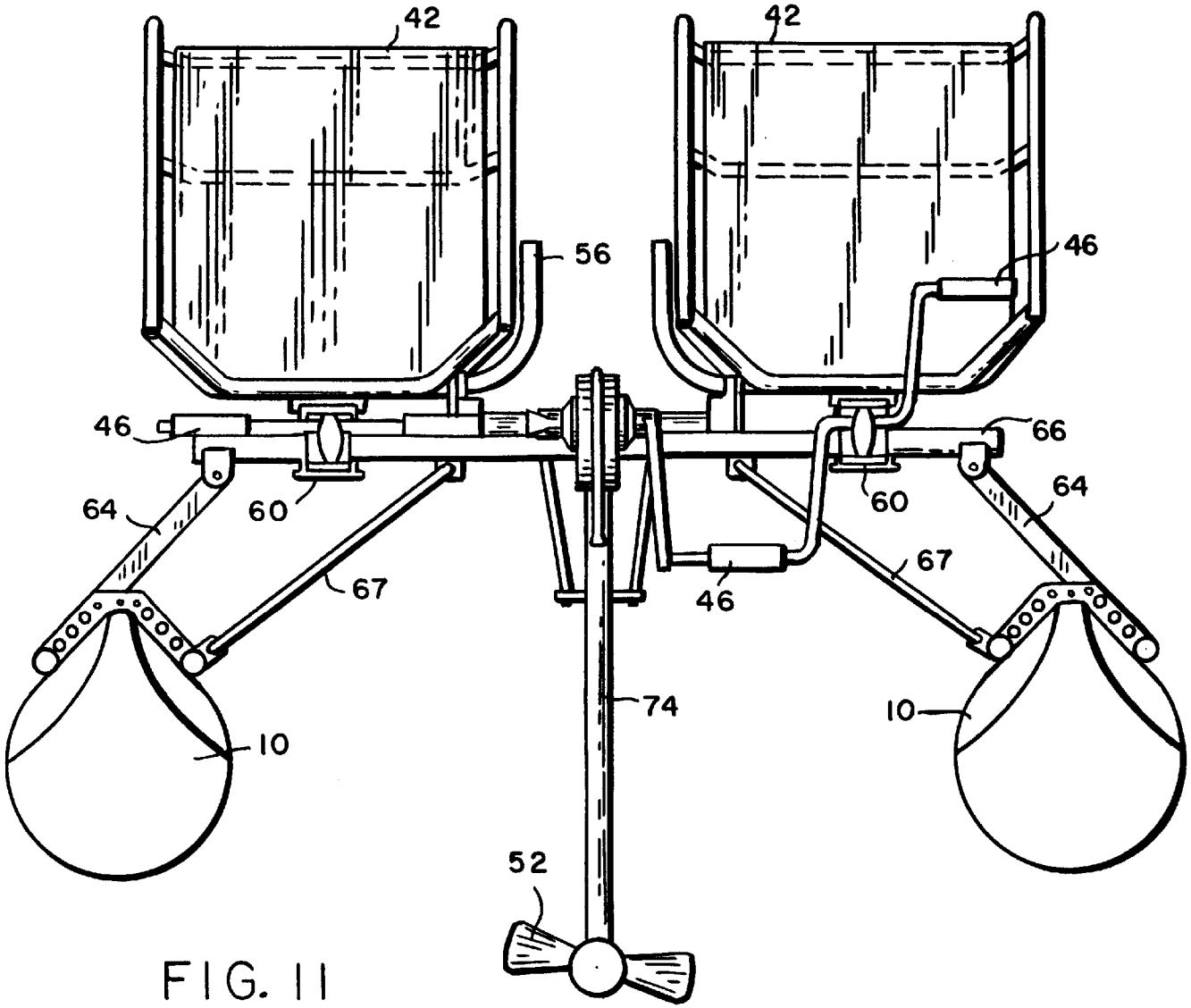
FIG. 11 shows a front view of a preferred multiple passenger watercraft of the invention.

As can be clearly seen in FIG. 7, seat platform 60 and drive mount 62 are mounted above the hulls by a pair of struts 64 mounted on each hull 10. Crossbars 66 extend across each pair of struts 64 as can be seen in FIG. 9. Preferably stabilizing extension arms 67 extend from the crossbars 66 to the base of struts 64 as shown in FIGS. 8 and 11 to further enhance the integrity of the craft structure. Seat 42 can be secured as desired along the length of platform 60 by manipulation of releasable lock system 68 so that any given passenger can be optimally positioned with respect to pedals 46. Preferably, the steering controls including tillers 56 move together with seat 42 as the seat is positioned as desired along the length of the watercraft. Preferably platform 60 includes a trolley type attachment of seat 42 to further facilitate positioning of the seat. Rudder beam 70 attaches to rudder 54 and seat platform 60 or crossbar 66 to secure the rudder to the craft. Rudder(s) 54 may be retracted as desired such as when approaching shore by rudder lift line 72 which suitably attaches by cleat or other means beneath passenger seat 42 as shown in FIG. 7. Propeller 52 together with drive shaft 74 also may be retracted toward the craft's stern via line 76 which suitably attaches by cleat or other means in front of seat 42 as shown in FIG. 7. Lines 72 and 76 suitably may be e.g. one inch nylon web cord.

A significant advantage of propulsion/steering/seating system 38 is that it can be readily removed from hulls 10 and disassembled to a compact size to enable convenient transport of the craft. For example, for the preferred system 38 depicted in FIGS. 7 and 8, struts 64 detach from mounting surfaces on hulls 10 and fold along the length of struts or cross bars 66, pivoting around attachment points 78. Propulsion system 44 releasably mounts on yoke 80 of drive mount 62 so that pedals 46, bevel gears and shaft 48 and propeller 52 can be removed and stored as a single unit. Preferably, various craft components are releasably attached with releasable pin and eye connections to facilitate convenient assembly and disassembly of a craft.

While system 38 may be suitably constructed of a variety of materials, preferably it is substantially formed from aluminum, particularly a powder-coated aluminum, in view of the light weight and durability of that material. Hardware on the craft is preferably stainless steel. Seat backing and base material 82 may be suitably a nylon mesh or canvas or the like.

As can be seen in FIGS. 7 and 9, preferably each hull has a sub-frame 84 extending along the hull length and mounted on hull top surface 10'. That sub-frame facilitates mounting of propulsion/steering/seating system 38 on the hulls. Sub-frame 84 is preferably formed from telescoping aluminum sections that permits convenient press-fit assembly and disassembly and storage. Sub-frame 84 can be mounted to the hulls by any of a variety of mechanisms, preferably a releasable attachment such as a series of buckled straps 85 as shown in FIG. 9 or the like.

Each hull also preferably has a pull strap 86 mounted at the forward and aft points as shown in FIG. 9 to aid moving the craft into and out of the water and the like. A watercraft also can be moved as desired by use of handles 84' at the fore and aft ends of the hull subframe as shown in FIGS. 7 and 9.

As discussed above, in addition to a pedal system, watercraft of the invention may be powered by other means, such as solar power through use of suitable solar panels mounted on one or more hulls. Commercially available solar panels can be mounted directly on exposed hull surfaces. Watercraft of the invention also may be powered by a gasoline or electric motorized system, e.g. where an outboard motor is mounted on a frame unit affixed to one or more hulls of the invention. Various power systems also may be used in combination, e.g. a craft may include both a pedal system as well as a solar powered system.

As discussed above, the relatively light weight and compact storage and transport sizes of watercraft of the invention provide for permit highly convenient storage and transport. Thus, preferred watercraft have a total weight of from about 60 to 70 or 80 or 90 pounds, and a storage size of from 7 to about 9 or 10 cubic feet.

Figure 10A:
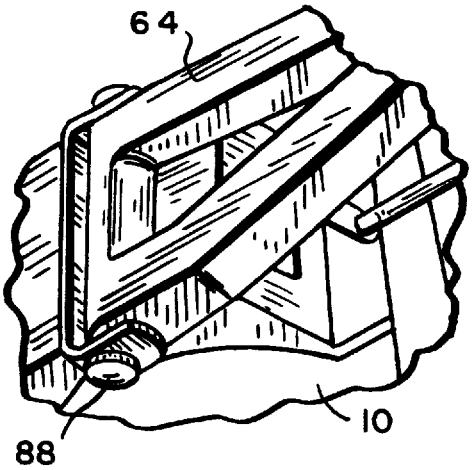
FIGS. 10A and 10B show preferred attachments of watercraft components of the invention.
Figure 10B:
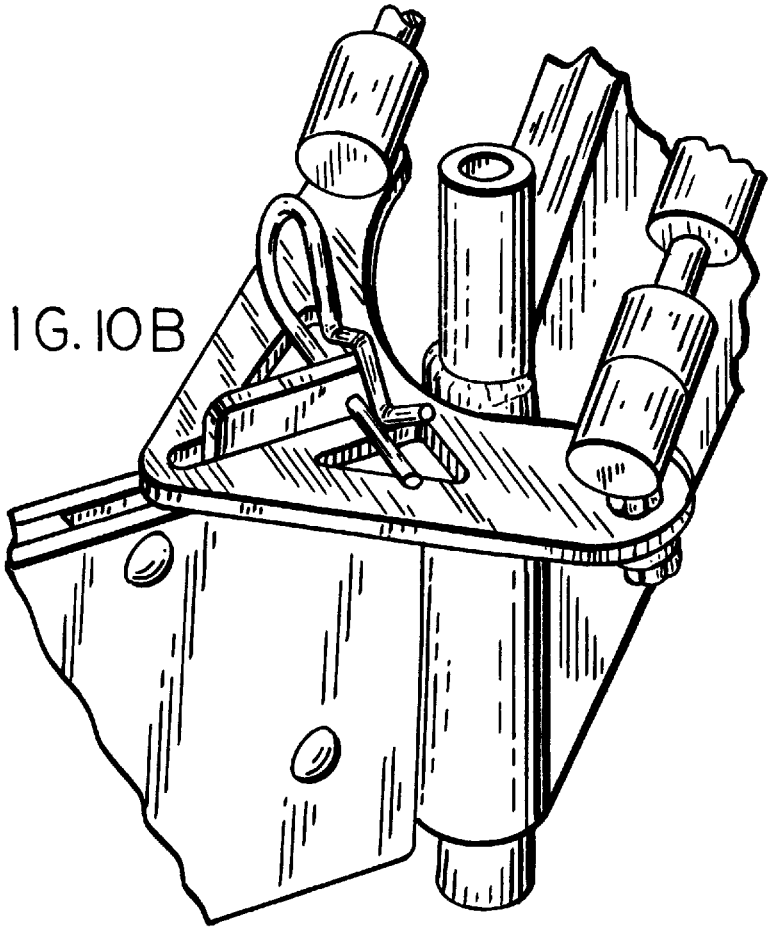

The rapid and convenient assembly and disassembly of watercraft as has been discussed above further add to the ease of use of the watercraft. In preferred systems, an entire craft can be reduced to only a few components for convenient storage and transport. For instance, for the watercraft depicted in FIG. 7, the entire craft can be conveniently stored and transported such as in a carrying bag as a total of seven components, namely 1) deflated hulls, 2) subframe 84 which is stored as compacted telescoping sections, 3) seat assembly with platform 60, crossbars 66 and pivoted struts 64, 4) propulsion system 44 as discussed above, 5) drive holder 62, 6) seat 42 folded flat and 7) the rudder 54 with extensions arms 58 and rudder beam 70. Preferred watercraft can be assembled and dissembled without the use of any tools other than the craft's components. Additionally, and as discussed above, watercraft components preferably have attachment mechanisms that facilitate assembly and disassembly. For instance, as shown in FIG. 10A, strut 64 can be mounted onto hull 10 and subframe 84 via a removable pin connection 88. FIG. 10B shows quick disconnect attachment of the rudder, control arms and the rudder beam.

Also, while a twin-hull design is particularly preferred, other preferred watercraft may include three or more hulls of the invention, such as a trimaran or other designs. The invention also includes craft that contain a single hull of the invention. Hulls of the invention can be employed for canoe designs including e.g. an outrigger design where the main canoe hull has a forward pivot axis in accordance with the invention, or where both the main hull and one or more side pontoons of the canoe have such a forward pivot axis.

Further, while FIGS. 7–9 depict a preferred single passenger design, watercraft of the invention include multiple passenger systems such as e.g. where passengers are positioned side-by-side, or behind one another.

More particularly, FIG. 11 shows a preferred two-passenger design that includes dual side-by-side passenger seats 42 with tiller handles 56 positioned therebetween. Also, the watercraft depicted in FIGS. 7–9 can be readily modified to accommodate this two passenger design by the addition of a further seat platform 60 and reconnection of tillers 56 to the interior position shown in FIG. 11. As also shown in FIG. 11, the two sets of pedals 46 are preferably offset by 90 degrees with respect to each other to enable efficient powering of the drive unit.

Other convenient retrofits of the design shown in FIGS. 7–9 also can be made. For example, a first seat 42 can be positioned to a side of the craft as shown in FIG. 11 with a stretcher attachment running along the hull's length positioned in the space of the second seat shown in FIG. 11. The stretcher could conveniently carry another passenger or provide storage for fishing or scuba gear or other items as desired.

Watercraft of the invention also suitably may have one or more interchangeable hulls. For example, a watercraft may have a set of inflatable hulls as well as a set of rigid hulls, e.g. fiberglass hulls, for use for instance in a coral region or other area where inflatable hulls may be less preferred. The entire subframe and propulsion/steering/seating systems can be adapted to interchangeably fit on either the rigid or inflatable hulls to enable convenient use of both systems as desired.

The present invention has been described in detail, including the preferred embodiments thereof. However, it will be appreciated that those skilled in the art, upon consideration of the present disclosure, may make modifications and/or improvements of this invention and still be within the scope and spirit of this invention as set forth in the following claims.

What is claimed is:

1. A watercraft hull having a pivot axis that is forward of the waterline fore-aft centerline, and wherein the pivot axis is forward of the fore-aft centerline from about 50 percent to about 75 percent of the distance from the fore-aft centerline to the waterline bow point, the hull having a substantially semi-circular cross sectional shape below the hull waterline, and wherein a centerline of the semi-circular cross-sectional shape that extends between the pivot axis and the hull waterline aft section is substantially parallel to and coincident with the hull waterline.

2. The watercraft hull of claim 1 wherein the diameter of the semi-circular cross-sectional shape decreases substantially constantly from the pivot axis to the hull fore and aft points.

3. The watercraft hull of claim 1 wherein the hull is inflatable.

4. A watercraft hull of claim 1 wherein the hull tapers upward relative to the hull fore-aft waterline centerline.

5. A watercraft comprising a hull having a pivot axis that is forward of the hull waterline fore-aft centerline, and wherein the pivot axis is forward of the fore-aft centerline from about 50 percent to about 75 percent of the distance from the fore-aft centerline to the waterline bow point, the hull having a substantially semi-circular cross sectional shape below the hull waterline, and wherein a centerline of the semi-circular cross-sectional shape that extends between the pivot axis and the hull waterline aft section is substantially parallel to and coincident with the hull waterline.

6. The watercraft of claim 5 wherein the watercraft comprises a plurality of hulls that are adjacent and substantially parallel with respect to one another, at least one of the hulls having a pivot axis forward of the hull waterline fore-aft centerline.

7. The watercraft of claim 6 wherein each of the hulls has a pivot axis that is forward of the fore-aft centerline.

8. The watercraft of claim 7 wherein a centerline of the semi-circular cross-sectional shape of each hull that extends between the pivot axis and the hull waterline aft point is substantially parallel to the hull waterline.

9. The watercraft of claim 7 wherein the diameter of the semi-circular cross-sectional shape of each hull decreases substantially constantly from the pivot axis to the hull fore and aft points.

10. The watercraft of claim 6 wherein each of the hulls is inflatable.

11. The watercraft of claim 10 wherein each of the hulls comprises a plurality of inflation bladders.

12. The watercraft of claim 11 wherein each of the bladders extends fore to aft along the hull.

13. The watercraft of claim 5 further comprising a passenger seat positioned adjustably along the length of the watercraft.

14. The watercraft of claim 13 wherein the watercraft comprises a plurality of hulls each having a pivot axis forward of the hull waterline fore-aft centerline.

15. The watercraft of claim 5 wherein the watercraft comprises a single hull.

16. The watercraft of claim 15 wherein the hull is inflatable.

17. A watercraft of claim 5 wherein the hull tapers upward relative to the hull fore-aft waterline centerline.

18. A method of propelling a pedal-operated watercraft comprising:

a) providing in a body of water a watercraft comprising 1) a hull having a pivot axis forward of hull waterline fore-aft centerline, the hull having a substantially semi-circular shape below the hull waterline, the fore-aft centerline of the semi-circular hull shape being substantially parallel to and coincident with the hull waterline between the hull aft and forward sections, and 2) a pedal-operated propulsion system; and b) pedaling to propel the watercraft through the water.

19. The method of claim 18 wherein the propulsion system comprises a drive shaft in communication with a pull-type propeller that extends into the water, the propeller facing the watercraft bow and positioned forward of the drive shaft.

20. The method of claim 18 wherein the propulsion system is positioned substantially coincident or forward of the hull waterline fore-aft centerline.

21. The method of claim 18 wherein the watercraft comprises a plurality of hulls that are adjacent and substantially parallel to one another, at least one of the hulls having a pivot axis forward of the hull waterline fore-aft centerline and a substantially semi-circular shape below the hull waterline.

22. The method of claim 18 wherein the watercraft comprises 1) two hulls that are adjacent and substantially parallel to one another, each of the hulls having a pivot axis forward of the hull waterline fore-aft centerline and a substantially semi-circular shape below the hull waterline, and 2) a rudder positioned between the two hulls.

23. The method of claim 18 wherein the hull aft end tapers upward proximate to the hull aft waterline point.

24. The method of claim 23 wherein the rudder is forward of the aft point of the hull.

25. The method of claim 18 wherein the hull bow tapers upward from the the substantially parallel fore-aft centerline of the semi-circular hull shape.

26. The method of claim 25 wherein the hull aft portion tapers upward from the substantially parallel fore-aft centerline of the semi-circular hull shape.

27. A watercraft hull having a pivot axis that is forward of the waterline fore-aft centerline, and wherein the pivot axis is forward of the fore-aft centerline, the hull having a substantially semi-circular cross sectional shape below the hull waterline, and wherein a centerline of the semi-circular cross-sectional shape that extends between the pivot axis and the hull waterline aft section is substantially parallel to and coincident with the hull waterline.

28. A watercraft comprising a hull having a pivot axis that is forward of the hull waterline fore-aft centerline, and wherein the pivot axis is forward of the fore-aft centerline, the hull having a substantially semi-circular cross sectional shape below the hull waterline, and wherein a centerline of the semi-circular cross-sectional shape that extends between the pivot axis and the hull waterline aft section is substantially parallel to and coincident with the hull waterline.

29. A watercraft comprising 1) a hull having a pivot axis that is forward of the hull waterline fore-aft centerline, the fore-aft centerline of the semi-circular hull shape being substantially parallel to and coincident with the hull waterline between the hull aft and forward sections, and 2) a removable propulsion and steering and seating system.

30. A watercraft comprising a hull having a pivot axis that is forward of the hull waterline fore-aft centerline, the fore-aft centerline of the semi-circular hull shape being substantially parallel to and coincident with the hull waterline between the hull aft and forward sections, and wherein a rudder is positioned aft of the fore-aft centerline.

31. A watercraft comprising a hull having a pivot axis that is forward of the hull waterline fore-aft centerline, the fore-aft centerline of the semi-circular hull shape being substantially parallel to and coincident with the hull waterline between the hull aft and forward sections, and wherein a propulsion system is positioned substantially coincident or forward of the hull waterline fore-aft center line.

32. A watercraft comprising a hull having a pivot axis that is forward of the hull waterline fore-aft centerline, the fore-aft centerline of the semi-circular hull shape being substantially parallel to and coincident with the hull waterline between the hull aft and forward sections, and wherein a propulsion system is positioned aft of the hull waterline fore-aft center line.

33. A watercraft comprising 1) a hull having a pivot axis that is forward of the hull waterline fore-aft centerline, the fore-aft centerline of the semi-circular hull shape being substantially parallel to and coincident with the hull waterline between the hull aft and forward sections, and 2) a fixed propulsion system.

34. A watercraft comprising 1) a hull having a pivot axis that is forward of the hull waterline fore-aft centerline, the fore-aft centerline of the semi-circular hull shape being substantially parallel to and coincident with the hull waterline between the hull aft and forward sections, and 2) a steerable propulsion system, and does not include a rudder.

35. A watercraft comprising a hull having a pivot axis that is forward of the hull waterline fore-aft centerline, the fore-aft centerline of the semi-circular hull shape being substantially parallel to and coincident with the hull waterline between the hull aft and forward sections, and wherein the watercraft can be stored in a container having a volume of about 10 cubic feet or less.

36. A watercraft comprising a hull having a pivot axis that is forward of the hull waterline fore-aft centerline, the fore-aft centerline of the semi-circular hull shape being substantially parallel to and coincident with the hull waterline between the hull aft and forward sections, and wherein the watercraft has a total weight of about 90 pounds or less.

37. The watercraft of claim 36 wherein the watercraft has a total weight of about 70 pounds or less.

38. The watercraft of claim 37 wherein the watercraft can be assembled without use of separate tools.

* * * * *